US010774621B2

(12) United States Patent
Eng

(10) Patent No.: US 10,774,621 B2
(45) Date of Patent: Sep. 15, 2020

(54) DEVICE AND METHOD FOR PERFORATION OF A DOWNHOLE FORMATION USING ACOUSTIC SHOCK WAVES

(71) Applicant: qWave AS, Stavanger (NO)

(72) Inventor: Hans Petter Eng, Stavanger (NO)

(73) Assignee: qWave AS, Stavanger (NO)

( * ) Notice: Subject to any disclaimer, the term of this patent is extended or adjusted under 35 U.S.C. 154(b) by 0 days.

(21) Appl. No.: 16/082,155

(22) PCT Filed: Mar. 15, 2017

(86) PCT No.: PCT/NO2017/050064
§ 371 (c)(1),
(2) Date: Sep. 4, 2018

(87) PCT Pub. No.: WO2017/160158
PCT Pub. Date: Sep. 21, 2017

(65) Prior Publication Data

US 2019/0093457 A1 Mar. 28, 2019

(30) Foreign Application Priority Data

Mar. 18, 2016 (NO) ..... 20160465

(51) Int. Cl.
*E21B 43/00* (2006.01)
*E21B 28/00* (2006.01)
(Continued)

(52) U.S. Cl.
CPC ..... *E21B 43/003* (2013.01); *E21B 7/24* (2013.01); *E21B 28/00* (2013.01); *E21B 43/11* (2013.01); *E21B 43/26* (2013.01)

(58) Field of Classification Search
CPC ..... E21B 43/003; E21B 7/24; E21B 28/00; E21B 43/11; E21B 43/26
See application file for complete search history.

(56) References Cited

U.S. PATENT DOCUMENTS 4,345,650 A * 8/1982 Wesley ..... E21B 36/04 166/177.2
6,427,774 B2 * 8/2002 Thomas ..... E21B 43/003 166/248

(Continued)

FOREIGN PATENT DOCUMENTS

CA 2889226 10/2015
NO 342214 4/2018

OTHER PUBLICATIONS

Norwegian Search Report, Norwegian Patent Application No. 20160465, dated Oct. 17, 2016.

(Continued)

*Primary Examiner* — Crystal J Miller
(74) *Attorney, Agent, or Firm* — Andrus Intellectual Property Law, LLP

(57) ABSTRACT

A device is for perforation of a downhole formation. The device has an electronically induced acoustic shock wave generator; and an acoustic shock wave focusing member. The device is adapted to focus generated acoustic shock waves onto an area of a borehole in order to disintegrate the downhole formation within said area. The device is adapted to generate a plurality of consecutive focused acoustic shock waves in order to gradually excavate a perforation tunnel, or to improve an already existing perforation tunnel, extending from said borehole and into said formation.

20 Claims, 9 Drawing Sheets

(51) Int. Cl.

| | |
|---|---|
| ***E21B 43/26*** | (2006.01) |
| ***E21B 7/24*** | (2006.01) |
| ***E21B 43/11*** | (2006.01) |

(56) References Cited

U.S. PATENT DOCUMENTS

| | | | | |
|---|---|---|---|---|
| 9,057,232 | B2 | 6/2015 | Cioanta et al. | |
| 2001/0011590 | A1* | 8/2001 | Thomas | E21B 43/003 166/248 |
| 2004/0159432 | A1* | 8/2004 | Johnson | E21B 21/00 166/297 |
| 2006/0096752 | A1 | 5/2006 | Barrientos | |
| 2006/0231257 | A1 | 10/2006 | Reed et al. | |
| 2010/0269676 | A1* | 10/2010 | Behrmann | E21B 43/117 89/1.15 |
| 2012/0165997 | A1* | 6/2012 | Lewis | E21B 21/08 700/282 |
| 2013/0161007 | A1 | 6/2013 | Wolfe et al. | |
| 2013/0228372 | A1 | 9/2013 | Linyaev et al. | |
| 2014/0305877 | A1* | 10/2014 | Cioanta | E21B 28/00 210/739 |
| 2015/0165445 | A1* | 6/2015 | Baym | B02C 19/18 367/137 |
| 2015/0308233 | A1 | 10/2015 | Parker et al. | |

OTHER PUBLICATIONS

International Search Report, PCT/NO2017/050064, dated Jun. 7, 2017.
Written Opinion, PCT/NO2017/050064, dated Jun. 7, 2017.

* cited by examiner

DEVICE AND METHOD FOR PERFORATION OF A DOWNHOLE FORMATION USING ACOUSTIC SHOCK WAVES

CROSS-REFERENCE TO RELATED APPLICATIONS

This application is the U.S. national stage application of International Application PCT/N02017/050064, filed Mar. 25, 2017, which international application was published on Sep. 21, 2017 as International Publication WO 2017/160158 in the English language. The International Application claims priority of Norwegian Patent Application No. 20160465, filed Mar. 18, 2016. The international application and Norwegian application are both incorporated herein by reference, in entirety.

FIELD

The present invention relates to a device for perforation of a downhole formation. More specifically the invention relates to a device for perforation of a downhole formation, said device comprising an electrically induced acoustic shock wave generator and an acoustic shock wave focusing member. The invention also relates to a tool assembly comprising one or more such devices as well as a method for operating the tool assembly.

BACKGROUND

Liquid communication between a ground formation and a wellbore is often established or enhanced by perforation tunnels in the formation. The perforation tunnels are created at the location of the formation, and they typically extend perpendicularly into the formation. Perforation tunnels are traditionally made using shaped charges of chemical explosives that inject a material into the formation, creating the tunnel.

In conventional perforating, the explosive nature of the process shatters sand grains of the formation. A layer of "shock damaged region" having a permeability lower than that of the virgin formation matrix may be formed around each perforation tunnel. The process may also generate a tunnel full of rock debris mixed in with the perforator charge debris. The shock damaged region and loose debris in the perforation tunnels are known to impair the productivity of production wells, or the injectivity of injector wells, and hence negatively impact upon the flow of liquids between the formation and the well.

U.S. Pat. No. 9,057,232 discloses methods and apparatuses for enhancing the oil recovery in oil wells by using shock waves for stimulating an oil-producing formation. This stimulation is inter alia done by creating arbitrary cracks in the formation adjacent previously formed perforation tunnels. The technology according to U.S. Pat. No. 9,057,232 is described used in preparation for hydraulic fracking operations and also during hydraulic fracking operations.

SUMMARY

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

A shock wave field is a spatial and temporal distribution of acoustic energy within a three dimensional space and time. It is characterized by basic parameters such as peak pressure and temporal behaviour of the pressure at different spatial positions within the field. The shock waves' forward-directed momentum, in the direction of its propagation, and its concentration in time are two main factors determining the effect of the shock wave. Another important factor being the feature of focusing the spatial pressure field, i.e. its concentration in space, by conserving and focusing the energy to a restricted area, as opposed to more radial or spherical propagation of the pressure field. The dynamic effect, for the most part, occurs at interfaces with a change in the acoustic impedance, such as when a shock wave propagating in a liquid impact on a ground formation. Also implying that a shock wave propagating in a liquid, while simultaneously being enclosed by matter of different acoustic impedance than the liquid, such as ground formation surrounding a perforation tunnel, the shock wave will conserve a great deal of its energy for a long distance, only to be released at the interface with a change in acoustic impedance in the direction of the shock wave propagation, such as at the end of the perforation tunnel, from now on referred to as "water-hammer effect".

Herein the term "focused" will be used both to describe acoustic shock waves that are directed in a certain direction, with a circular cross-section normal to the direction of propagation, such as collimated waves with a specific focus area, and shock waves that are concentrated/converging towards a focal point, or focus area when projected on a target object, such as the inside of a borehole wall.

Directed shock waves will include guided, non-spherical spatial forward projections of shock waves. This will typically be the case when an acoustic shock wave generator is situated and actuated within a parabolic reflector, when actuating a flat acoustic shock wave generator as standalone, or when actuating a flat acoustic shock wave generator in combination with an acoustic horn.

Concentrated shock waves include shock waves generated from shock wave generators situated within or on concentrating reflectors, such as an elliptically or spherically shaped reflector, or behind concentrating acoustic lens(es).

Different focusing members for focusing generated acoustic shock waves will be described in the following. The focusing members include reflectors of parabolic, elliptic, spherical, flat or other similar shape configurations as well as various types of concentrating and/or collimating acoustic lenses.

It should also be noted that combinations of different focusing members, both directed and concentrated, may be used to obtain a desired focus of an acoustic shock wave.

It is an objected of the present invention to utilize the energy exerted by a series of electronically induced focused acoustic shock waves to create new perforations, or to improve (such as widening or extending) existing perforations, in a ground formation by way of the gradual deterioration/disintegration of the formation, such as by fracturing of grains, loosening single grains, or cluster of grains, by dispatching the bonds that naturally exists between the grains, taking place at each shock wave impact on the formation. This is achieved by ensuring, and controlling, that the acoustic shock wave, within the focus area, has sufficiently high power density to disintegrate the formation so that a perforation tunnel may be formed by the series of consecutive focused acoustic shock waves.

While the peak pressure within the focus area is typically in the range of 10's to 1000's Bar when exerted by an acoustic shock wave generator technique, the peak pressure exerted by an explosive shape charge is typically in the magnitude of 100 k's Bar. Therefore, the use of focused acoustic shock waves will cause significantly less damage to the formation, compared to using shaped explosive charges, while still exerting sufficient energy for a gradual, and gentle, excavation of new perforation tunnels or improving of existing perforation tunnels. The relatively low energy excavation implies that the virgin permeability of the formation will not be compromised. Optionally keeping the wellbore in an underbalanced condition during all or parts of the perforation operation, and/or creating the perforation tunnels with an upwardly inclination may ensure cleaning of debris out from the perforation tunnels, having the advantage that debris will not impair the propagation of subsequent shock waves into the perforation tunnel thus leading to a more efficient excavation of the perforation tunnel.

In a first aspect, the invention relates to a device for perforation of a downhole formation, said device comprising:

an electronically induced acoustic shock wave generator; and an acoustic shock wave focusing member, wherein said device is adapted to focus generated acoustic shock waves onto an area of a borehole in order to disintegrate the downhole formation within said area; and wherein the device is further adapted to generate a series of focused acoustic shock waves in order to gradually excavate a perforation tunnel extending from said borehole and into said formation.

Reference is made to CA 2889226 for a detailed description of how a series of electronically induced acoustic shock waves may be generated.

The device according to the invention is adapted to generate a series of focused acoustic shock waves that will travel through a liquid in the well, towards the formation and release its energy in contact with the formation so as to disintegrate the formation. By repeating this process over and over again, a perforation tunnel will gradually be excavated from the borehole into the adjacent formation.

Herein, when referring to acoustic shock wave generators, it should be understood that it relates to electronically induced acoustic shock wave generators. Examples of such acoustic shock wave generators are electrohydraulic, piezoelectric or electromagnetic generators, all adapted to generate acoustic shock waves via generation of short, electric pulses. The electronically induced acoustic shock wave generators have the advantage over shaped charges of chemical explosives to have repeatability, and an easier controllable and lower energy output, for a gentler interaction with the formation as mentioned above.

The power density required to disintegrate the formation will vary greatly between different formation types and will therefore require different energy outputs from the acoustic shock wave generator. In a normal perforation operation, as per the invention, hundreds and even thousands of consecutive acoustic shock waves may be generated and focused onto the formation in order to gradually excavate a perforation tunnel as intended.

In one embodiment, said acoustic shock wave focusing member may be adapted to focus generated acoustic shock waves in a non-spherical spatial forward projection. This may be achieved by placing the shock wave generator in or on a collimating reflector, such as a parabolic or flat reflector or a cylindrical tube with one open end, or it may be achieved by using a collimating acoustic lens, or an acoustic horn.

In addition or as an alternative, the acoustic shock wave focusing member(s) may be adapted to concentrate generated acoustic shock waves onto a focal point or a focus area. This may be achieved by using a concentrating acoustic reflector or lens. Examples of concentrating acoustic reflectors are elliptically or spherically shaped reflectors. Alternatively the acoustic shock wave may be concentrated by means of an acoustic, concentrating lens.

In one embodiment the device may at least partially be covered by a flexible membrane. The membrane may be particularly useful when the acoustic shock wave generator is of an electrohydraulic type as the membrane may contribute to enclosing the shock wave generator, typically by covering an opening in a reflector in which the shock wave generator is placed, in order to maintain a controlled liquid environment for the electrohydraulic generator. This has the advantage of enabling control and reproducibility of the energy characteristics of the acoustic shock wave generator. The flexibility of the membrane may ensure smooth transfer of acoustic energy past the membrane without substantial absorption of energy therein.

It should also be mentioned that a device according to the present invention may include a plurality of acoustic shock wave generators that operate in parallel or in series. In one embodiment, a plurality of piezoelectric or electromagnetic acoustic shock wave generators may be provided on a substantially spherically shaped reflector, while in another embodiment a plurality of piezoelectric or electromagnetic acoustic shock wave generators may be provided in a stacked arrangement.

In a second aspect, the invention is related to a tool assembly comprising a device according to the first aspect of the invention, the tool assembly being connectable to a wellbore conveying means. The conveying means may be wireline or slickline or a liquid carrying string, including coil tubing, electric coil tubing, and various types of work and drill strings. The conveying means may be adapted to transfer energy and signal communication between the surface to the tool assembly. Preferably, the signal communication may be bi-directional. The energy transfer may be in the form of electric power for driving the device according to the invention and/or it may be in the form of electric and/or hydraulic power for driving other parts of the tool assembly mentioned in the following. It may also be in the form of laser energy transmitted from the surface. It should also be mentioned that the tool assembly may carry its own power generator as an addition or alternative to the supply from the surface. The downhole power generators may be in the form of batteries and/or downhole motors, such as downhole mud motors. The actual conveyance may be actuated from the surface by moving the conveyance means and/or by means of a wireline tractor.

In one embodiment, the tool assembly may comprise a casing perforation member. It should be mentioned that the term "casing" when used herein, also includes liner. The casing perforation member may be a high energy laser receiving power from the surface or downhole. Alternatively the casing perforation member may be a mechanical tool or water jetting tool. This may be beneficial when it is desirable to make a perforation tunnel via a non-perforated casing. The device according to the invention may be regarded a relatively low-energy device for gradually excavating a perforation tunnel into a formation for reasons explained above. It may therefore be beneficial to provide the tool assembly with a casing perforation member for creating a perforation opening through the actual casing, for which the focused acoustic shock waves may be unsuitable. Examples of laser cutting/perforation tools are disclosed in US 2013228372 and US 2006231257 to which reference is made for an in-depth description of laser cutting/perforation tools. In another embodiment, the casing perforation member may be a perforation gun using explosives to make holes in the casing. In yet another embodiment, the casing perforation member may be a plasma cutter. A plasma cutter may be particularly advantageous as it may utilize/share components situated within the same acoustic shock wave sub as intended to power/control/operate the device according to the first aspect of the invention.

In addition, or as an alternative, the tool assembly may be provided with a perforation opening localization member. This may be particularly useful if it is required to position and align the acoustic shock wave focusing member adjacent an already created perforation opening in a casing. The perforation openings may be created during the same run into the well or during a previous run into the well, or the casing may be pre-perforated on the surface prior to installation in the well. Activation of pre-created perforation openings may be done by means of slidable or rotatable sleeves. A continuous perforation tunnel may then be formed, using focused acoustic shock waves, by first excavating through a layer of cement in the annulus outside the casing and then subsequently into the adjacent formation. It may also be useful to locate perforation openings in already created perforation tunnels in a situation where it is desirable to improve the perforation tunnel, e.g. by removing scale and/or repairing damaged zones and/or widening/extending the already created perforation tunnels. The perforation opening localization member may be of a mechanical caliper type, or it may utilize radar, electromagnets or various sonic and ultrasonic localisation techniques as will be understood by a person skilled in the art.

In one embodiment, the tool assembly may be adapted to create local underbalanced pressure conditions in the well adjacent the formation being perforated by means of the tool assembly according to the present invention. This may be achieved by expanding a pair of packers with an axial distance therebetween on both sides of the tool assembly so as to isolate an area of the wellbore in which the tool assembly is positioned. This has the advantage of simplifying cleaning of debris from the excavated perforation tunnels as the debris may be transported into the well with the flow of liquid generated due to the pressure difference between the formation and the isolated area of the wellbore. Alternative methods, not necessarily using the tool assembly as such, of maintaining the well at a lower pressure than the formation pressure are discussed below.

In one embodiment, the tool assembly may comprise a formation imaging member. This may be particularly useful for following the process and quality of the gradual excavation of a perforation tunnel. The formation imaging device may indicate the length and/or quality of the perforation tunnel, and may be used as an indication for when a perforation operation is to be considered finalized. The imaging device may be a radar, an ultrasonic sensor, a laser operating in a low power mode etc.

It should also be mentioned that a tool assembly according to the second aspect of the present invention may also comprise number of different tool members not necessarily mentioned herein, but some of which will be mentioned in the following: guide assembly, cable head, roller section, a casing collar locator, swivel, various LWD/MWD tools, a wireline formation tester, such as a modular formation dynamics tester (MDT), a vertical positioning section, a casing cutting section, a well tractor, a packer or packers and also means for anchoring the tool assembly in the well, which may be useful for keeping the tool at a substantially fixed position during the gradual excavation of perforation tunnels into the formation.

It should also be mentioned that a tool assembly according to the second aspect of the invention may comprise a plurality of devices according to the first aspect of the invention that may be adapted to simultaneously and gradually excavate a plurality of perforation tunnels from the borehole and into the adjacent formation. The plurality of devices according to the first aspect, when integrated in a tool assembly according to the second aspect of the invention, may be identical or they may be of different embodiments. In one embodiment said plurality of devices according to the first aspect of the invention may be distributed axially and circumferentially along and around said tool assembly, respectively, in a predetermined pattern, the predetermined pattern coinciding with the distribution of perforation holes in the casing. This implies that it will be sufficient to localize one of the perforation holes, or a general indexing member, in the casing and align one of the acoustic shock wave focusing members to this perforation hole, then all the other shock wave focusing members will automatically align with the remaining perforation holes in the casing.

In one embodiment, the tool assembly may at least partially be covered by a flexible membrane. The flexible membrane thus a least partially cover a plurality of devices according to a first aspect of the invention.

In a third aspect, the invention relates to a method for operating a tool assembly according to the second aspect of the invention, the method comprising the steps of:

(A) running the tool assembly into a well on a tool assembly conveying means and placing the tool assembly adjacent a formation in the well;

(B) activating said acoustic shock wave generator;

(C) focusing a generated acoustic shock wave onto a focus area on the borehole in order to disintegrate the formation within said area; and (D) gradually excavating a perforation tunnel into said formation by means of a plurality of consecutive focused acoustic shock waves.

In one embodiment, the method may further comprise, prior to steps (B)-(D) further includes the step of: (A1) creating perforation openings in a downhole casing by means of a casing perforation member. This may be useful in a cased hole where the casing is not yet perforated.

In addition, or as an alternative, the method may further comprise, prior to steps (B)-(D), the step of:

(A2) localizing one or more already existing perforation openings in a casing by means of a perforation opening localization member. This may be perforation openings recently created by means of the casing perforation member as described above, or the perforation openings may be created in an earlier run into the well. After said one or more perforation openings have been located, the downhole tool assembly may be positioned so that one or more devices to the first aspect of the invention are aligned with the perforation openings.

In one embodiment, the step (D) of the method may further include the sub-step of: (D1) excavating the perforation tunnel with an axial direction having an upwardly vertical component in the direction from the borehole and into the formation. This may be particularly useful for cleaning of the excavated perforation tunnel, as the gravity may assist in getting the debris out into the wellbore.

The method may further include the step:

(E) maintaining the wellbore at a pressure lower than the formation pressure, at least in the area around said tool assembly when in operation. This may result in a suction force that will contribute to extracting debris from the perforation tunnels and into the well, having the advantage that debris will not impair the propagation of subsequent shock waves into the perforation tunnel thus leading to a more efficient excavation of the perforation tunnels. The reduced well pressure may also be realized by manipulation of the well conditions by creating an underbalanced condition in the wellbore, where the formation pressure is higher than the pressure in the wellbore. For example, reducing the pressure at the wellhead to allow the well to produce to the surface on its own, or, in the case of tighter or pressure depleted formations, with assistance from artificial lift methods such as downhole gas-lift or electric submersible pump, subsea booster, sucker-rod pump, or similar. Also, a lighter liquid may be pumped into the wellbore creating a lower pressure in the wellbore. In another embodiment, a transient underbalanced condition may be created in an isolated region of the wellbore, which may be isolated by means of one or more packers that may be parts of the tool assembly according to the second aspect of the invention. Creation of a transient underbalance condition can be accomplished in a number of different ways, such as by use of a low pressure chamber that is opened to create the underbalance condition.

In one embodiment, the method according to the third aspect of the invention may also include, in combination with or as a pre-step to, running a downhole wireline formation tester, such as a MDT (modular formation dynamics tester) tool or similar, into the wellbore, with the aim of enhancing the coupling between the probe(s) of the wireline formation tester and the borehole, as well as the communication between the borehole and a more virgin formation, for improved measurement/sampling quality.

It should be understood that by "borehole" is also meant any mudcake present with varying degree of thickness and density on the inside of the wellbore. A person skilled in the art will understand that mudcake will typically be generated as a residue in drilling operations when a slurry, such as a drilling fluid, is forced against a permeable medium under pressure. The mudcake as such will normally be less dense, and thus more easily disintegrated, than the formation by the focused acoustic shock waves.

Further to the above, by "borehole" is also meant any cement present in the wellbore. If cement is present in the wellbore, typically outside the casing adjacent the formation, a tunnel will have to be excavated through the cement before the rest of the formation is reached.

BRIEF DESCRIPTION OF THE DRAWINGS

In the following is described an example of a preferred embodiment illustrated in the accompanying drawings, wherein.

DETAILED DESCRIPTION OF THE DRAWINGS

Figure 1:
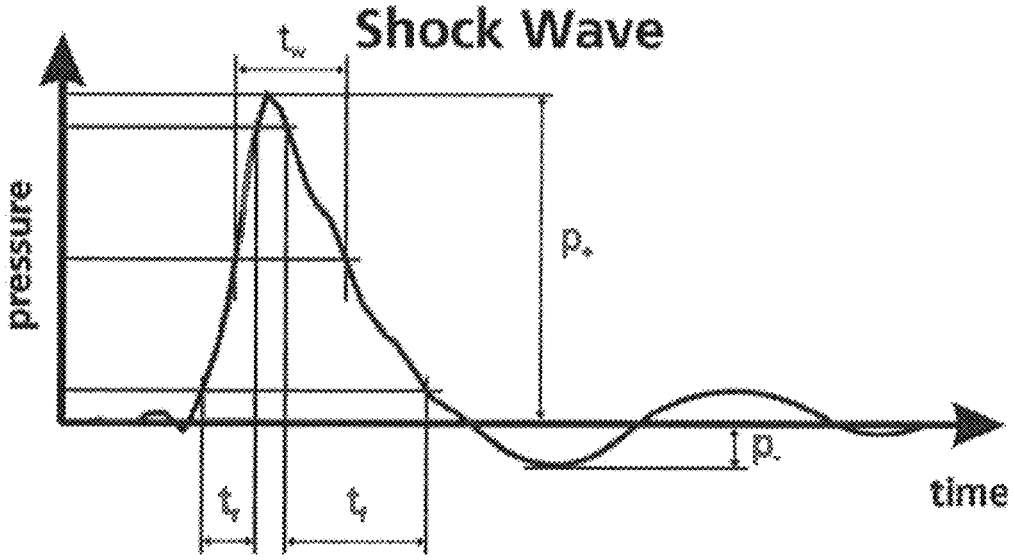
FIG. 1 shows temporal pressure variation of an acoustic shock wave.

In the following, the reference numeral 1 will indicate a device according to the first aspect of present invention, whereas the reference numeral 10 will indicate a tool assembly according to the second aspect of the invention, the tool assembly 10 comprising one or more devices 1 according to the first aspect of the invention. The drawings are shown schematically and simplified and the various features in the drawings are not necessarily drawn to scale.

A shock wave field is a spatial and temporal distribution of acoustic energy within a three-dimensional space. In FIG. 1, an example of a temporal pressure variation of a typical acoustic shock wave is shown. The impact that such an acoustic shock wave will have on a downhole formation depends both on the energy contained in the acoustic shock waves as well as its confinement in time and space. The actual power density required to disintegrate the formation will vary greatly between different types of downhole formations.

Figure 2:
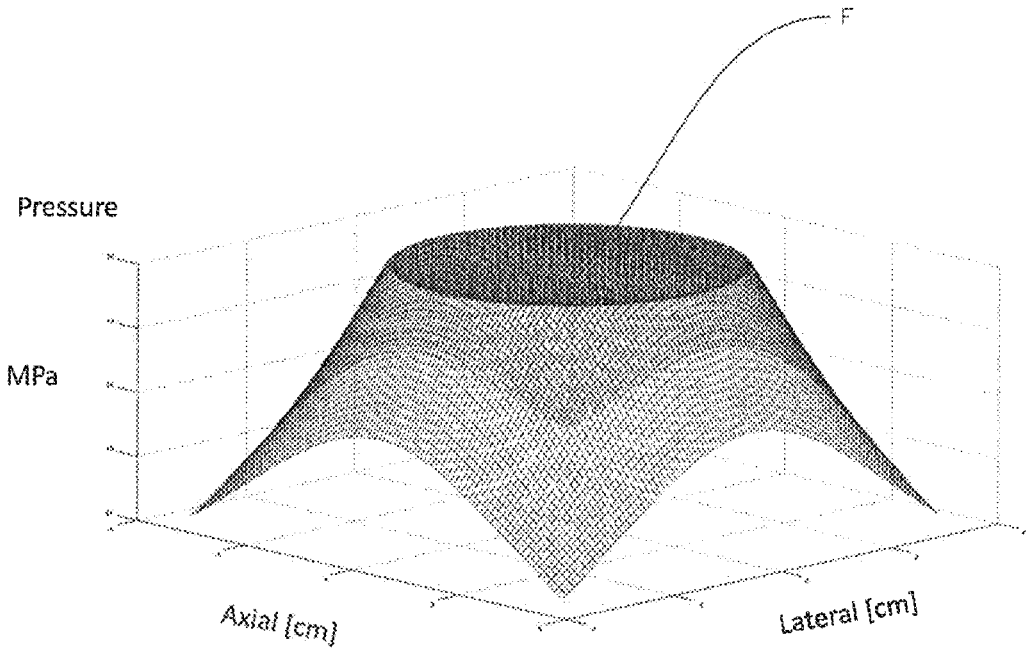
FIG. 2 shows spatial pressure distribution in a focus area of a directed acoustic shock wave field.

In FIG. 2 the pressure distribution near the focus area of a substantially ideal directed/collimated acoustic shock wave is shown. The pressure within the focus area F is substantially uniform in the direction normal to the propagation of the acoustic wave. In use in a device 1 according to the first aspect of the invention, the power density in the focus area will be optimized so as to be sufficient to disintegrate the formation area onto which the acoustic shock wave is directed. It will thereby, by generating a series of consecutive focused acoustic shock waves, be possible to gradually excavate a perforation tunnel into the formation. The devices 1 shown in FIGS. 4 and 8, discussed below, are adapted to generate a pressure distribution similar to the one shown in FIG. 2.

Figure 3:
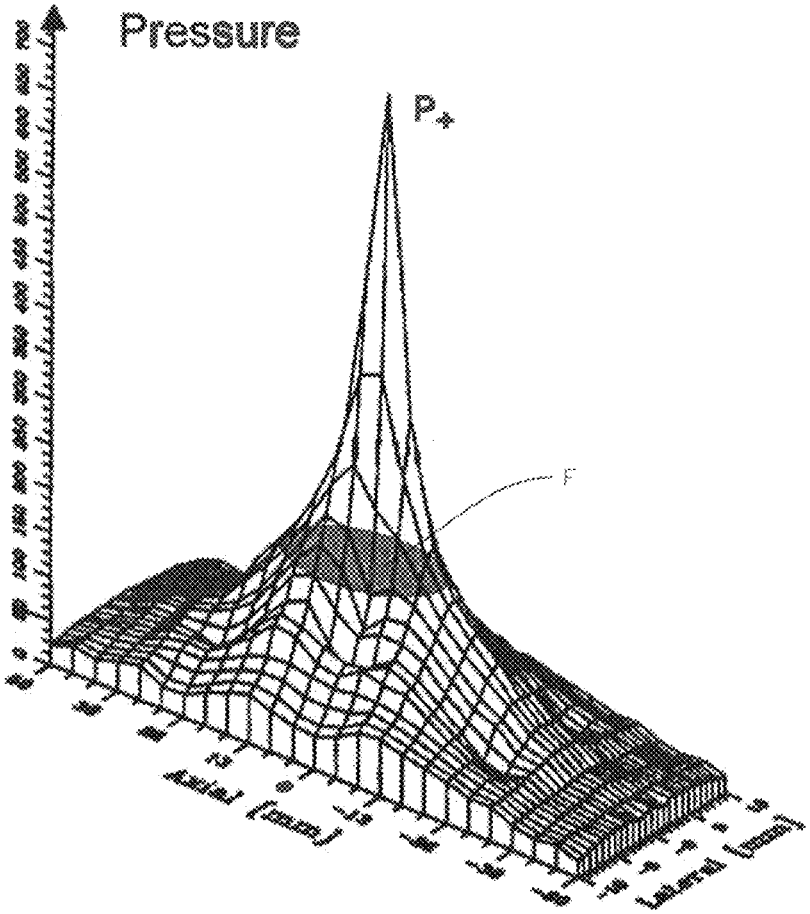
FIG. 3 shows spatial pressure distribution in a focus area of a concentrated acoustic shock wave field.

In contrast, FIG. 3 shows the corresponding pressure distribution for a concentrated acoustic shock wave with a focus area F and a focal point P+ at its peak. Such a pressure distribution will be obtainable by means of the devices shown in FIGS. 5-7, discussed below. The focus area F is still described as the area, normal to the direction of propagation, in which the shock wave has sufficient power density to disintegrate the formation.

Figure 4:
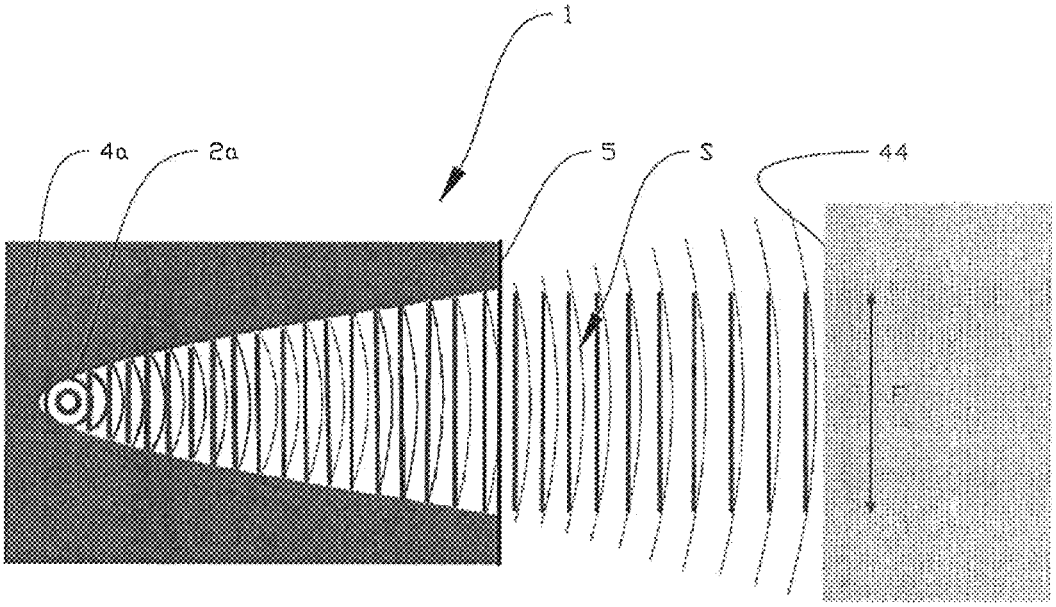
FIG. 4 shows, in a cross-sectional view, a first embodiment of a device according to the first aspect of the invention.

FIG. 4 shows a first embodiment of a device 1 according to the first aspect of present invention. An acoustic shock wave generator, here in the form of an electrohydraulic generator 2*a*, is placed within an acoustic shock wave focusing member 4*a* in the form of a parabolically shaped reflector. The parabolic reflector 4*a* spreads acoustic shock waves S from the electrohydraulic generator 2*a* and focuses the acoustic shock waves S in a collimated spatial forward projection onto a focus area F on a borehole 44 of a wellbore. The acoustic wave front includes a combination of a directed, focused part of the waves, and a weaker, unfocused/diverging part of the wave. A flexible membrane 5 is provided across the opening of the parabolic reflector 4*a* in order to maintain the electrohydraulic generator 2*a* in a controlled, liquid-filled environment to ensure control and reproducibility of the energy characteristics of the electrohydraulic generator 2*a*. The flexibility of the membrane 5 may ensure smooth transfer of acoustic energy past the membrane 5 without substantial absorption of energy therein.

Figure 5:
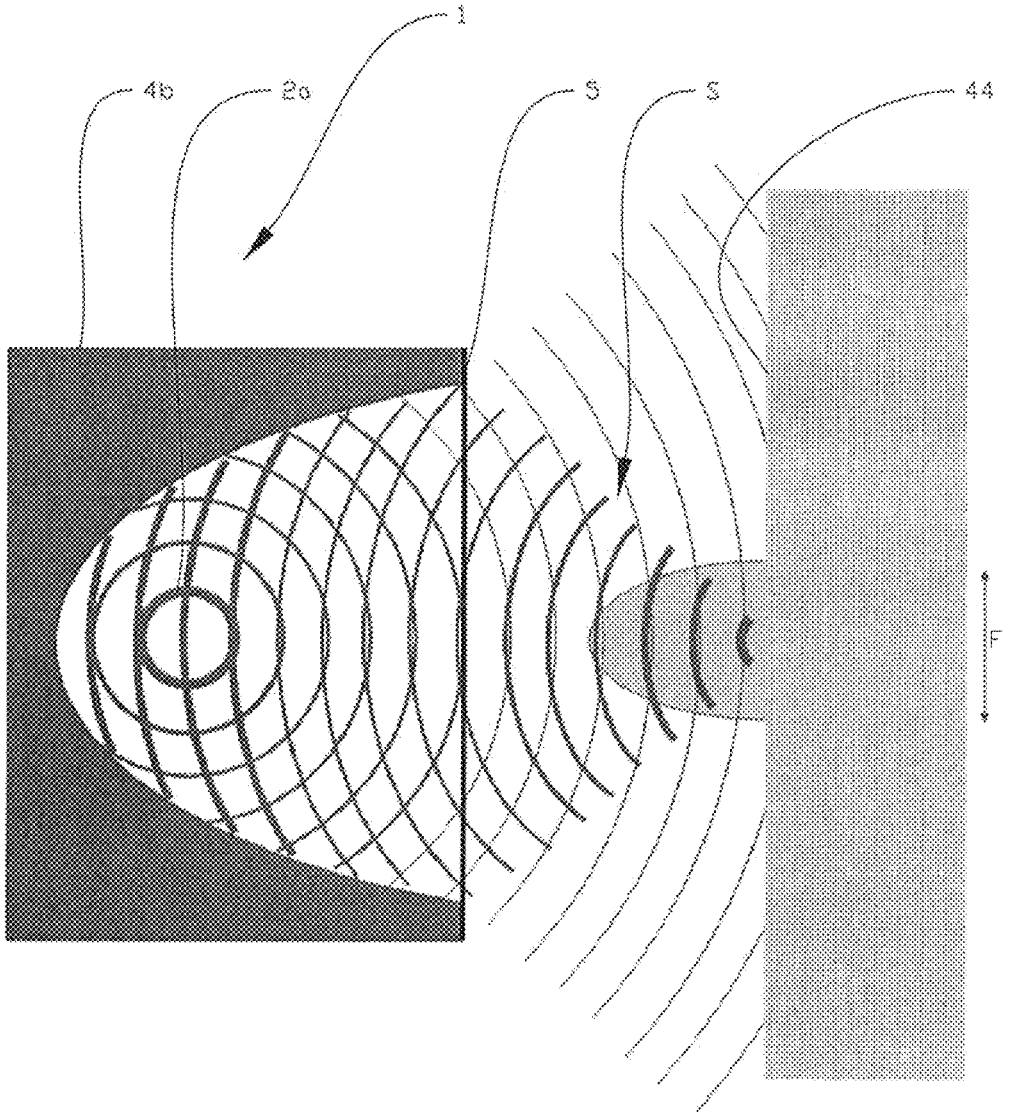
FIG. 5 shows, in a cross-sectional view, a second embodiment of a device according to the first aspect of the invention.

FIG. 5 shows a second embodiment of a device 1 according to the first aspect of the present invention. An acoustic shock wave generator, here in the form of an electrohydraulic generator 2*a*, is placed within an acoustic shock wave focusing member 4*b* in the form of an elliptically shaped reflector that concentrates, rather than collimates, generated acoustic shock waves S onto a focus area F of a borehole 44 in a wellbore. The main part of the wave front is converging towards the focus area F, while a weaker part of the wavefront is diverging. The opening in the elliptically shaped reflector 4*b* is covered by a flexible membrane 5 for similar reasons as discussed above.

Figure 6:
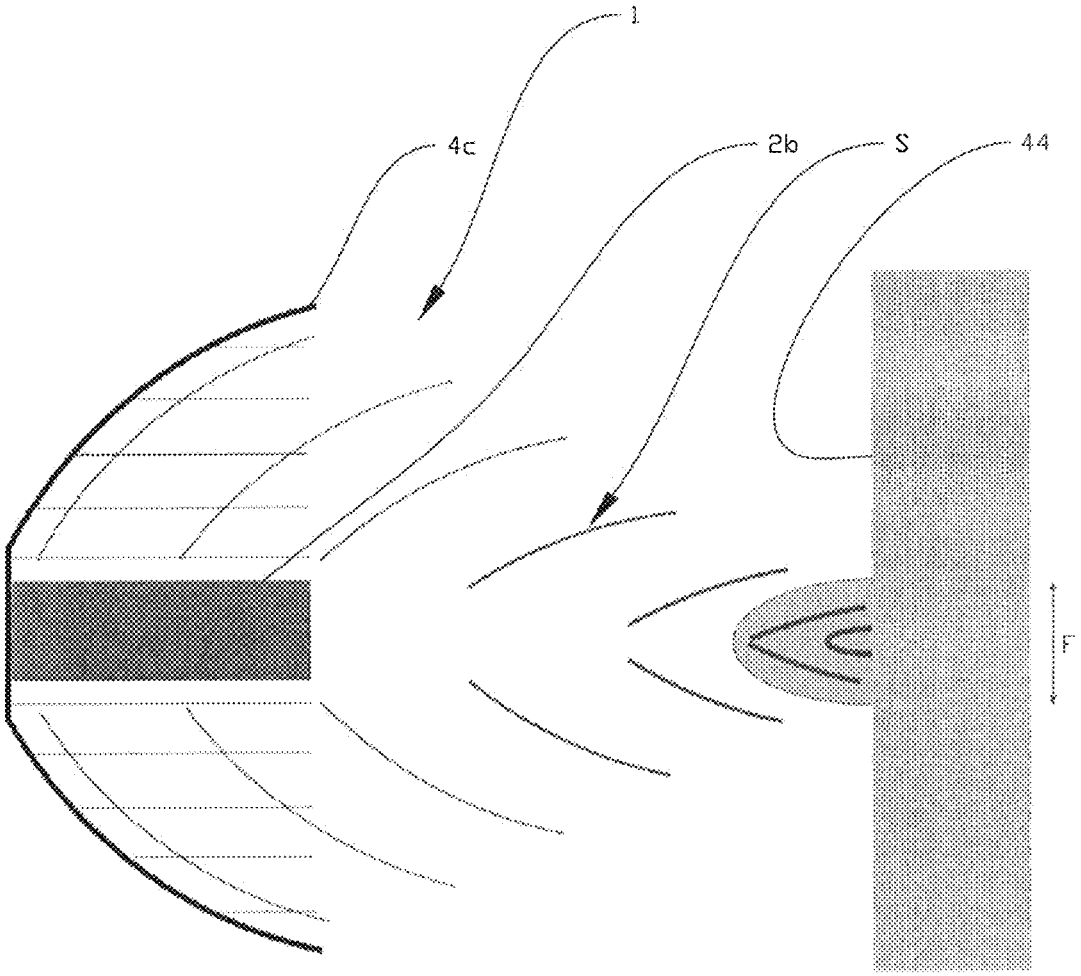
FIG. 6 shows in a cross-sectional view, a third embodiment of a device according to the first aspect of the invention.

FIG. 6 shows a third embodiment of a device 1 according to the first aspect of the invention. In the figure an acoustic shock wave generator, here in the form of a cylindrical electromagnetic generator 2*b*, is placed within an acoustic shock wave focusing member 4*c* in the form of a parabolically shaped reflector. Generated acoustic shock waves S are focused onto an area F on the borehole 44 in a converging wavefront. The electromagnetic generator 2*b* could also have been provided as a piezoelectric generator in an alternative embodiment.

Figure 7:
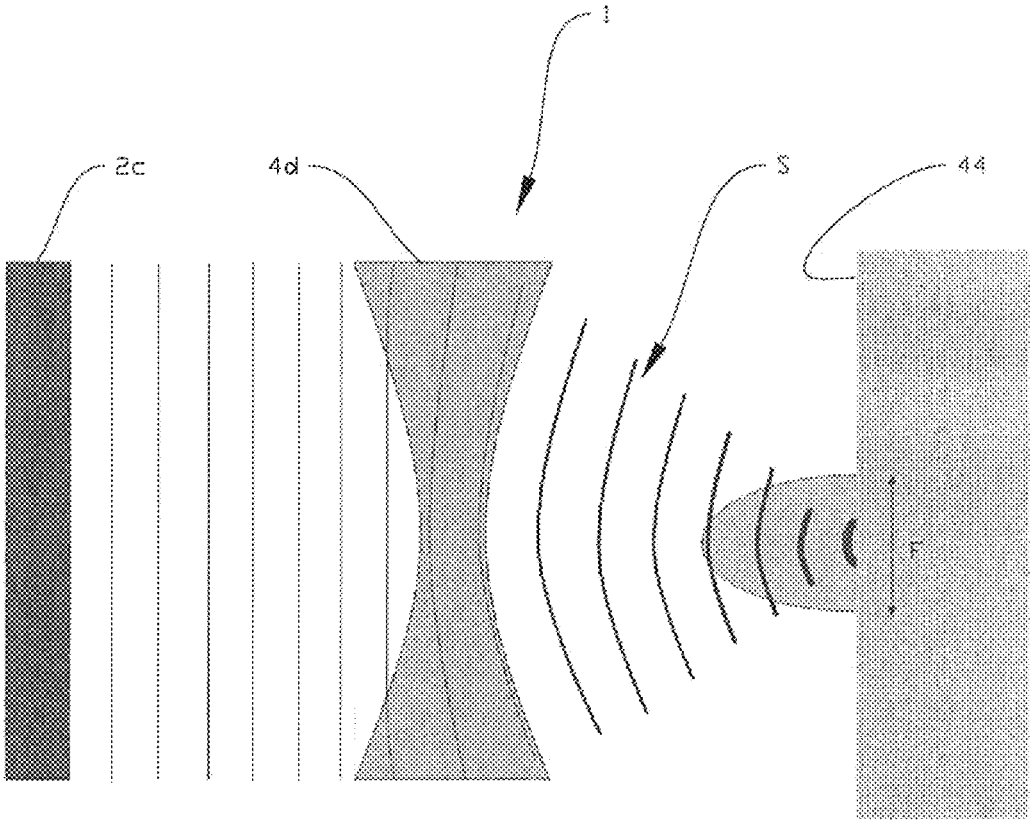
FIG. 7 shows in a cross-sectional view, a fourth embodiment of a device according to the first aspect of the invention.

FIG. 7 shows a fourth embodiment of a device 1 according to the first aspect of the invention. An acoustic shock wave generator, here in the form of a substantially circular, flat piezoelectric generator 2*c*, is shown generating acoustic shock waves S that propagate towards an acoustic shock wave focusing member in the form of a concentrating acoustic lens 4*d* that concentrates and projects the acoustic shock waves S onto an area projection F on the borehole 44 of a wellbore in a converging wavefront. In an alternative embodiment, the shown circular, flat generator could also be electromagnetic. In another embodiment, a plurality of circular and flat piezoelectric or electromagnetic generators may be provided in a stacked arrangement.

Figure 8:
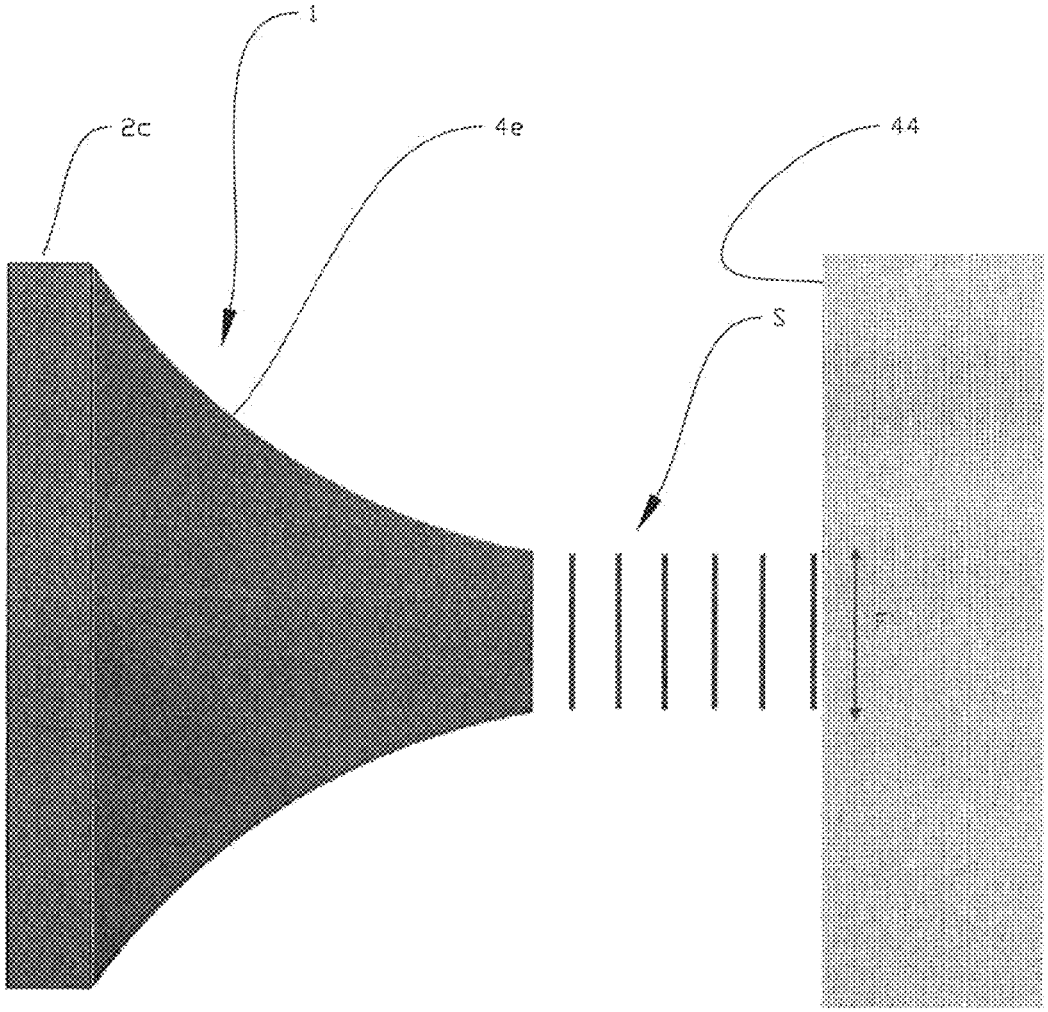
FIG. 8 shows, in a cross-sectional view, a fifth embodiment of a device according to the first aspect of the invention.

FIG. 8 shows a fifth embodiment of a device 1 according to the first aspect of the invention. An acoustic shock wave generator, here in the form of a substantially circular, flat piezoelectric generator 2*c*, is shown generating acoustic shock waves S that propagate towards an acoustic shock wave focusing member in the form of an acoustic horn 4*e*, resulting in a collimated wavefront onto the focus area F on the borehole 44. The acoustic horn 4*e*, which is interchangeably referred to as an ultrasonic horn, is typically formed in a piece of metal, such as titan, and fixedly connected, by means of gluing, welding, bolts etc., to the generator 2*c*. In an alternative embodiment, the shown circular, flat generator could also be electromagnetic. In another embodiment, a plurality of circular and flat piezoelectric or electromagnetic generators may be provided in a stacked arrangement.

Figure 9:
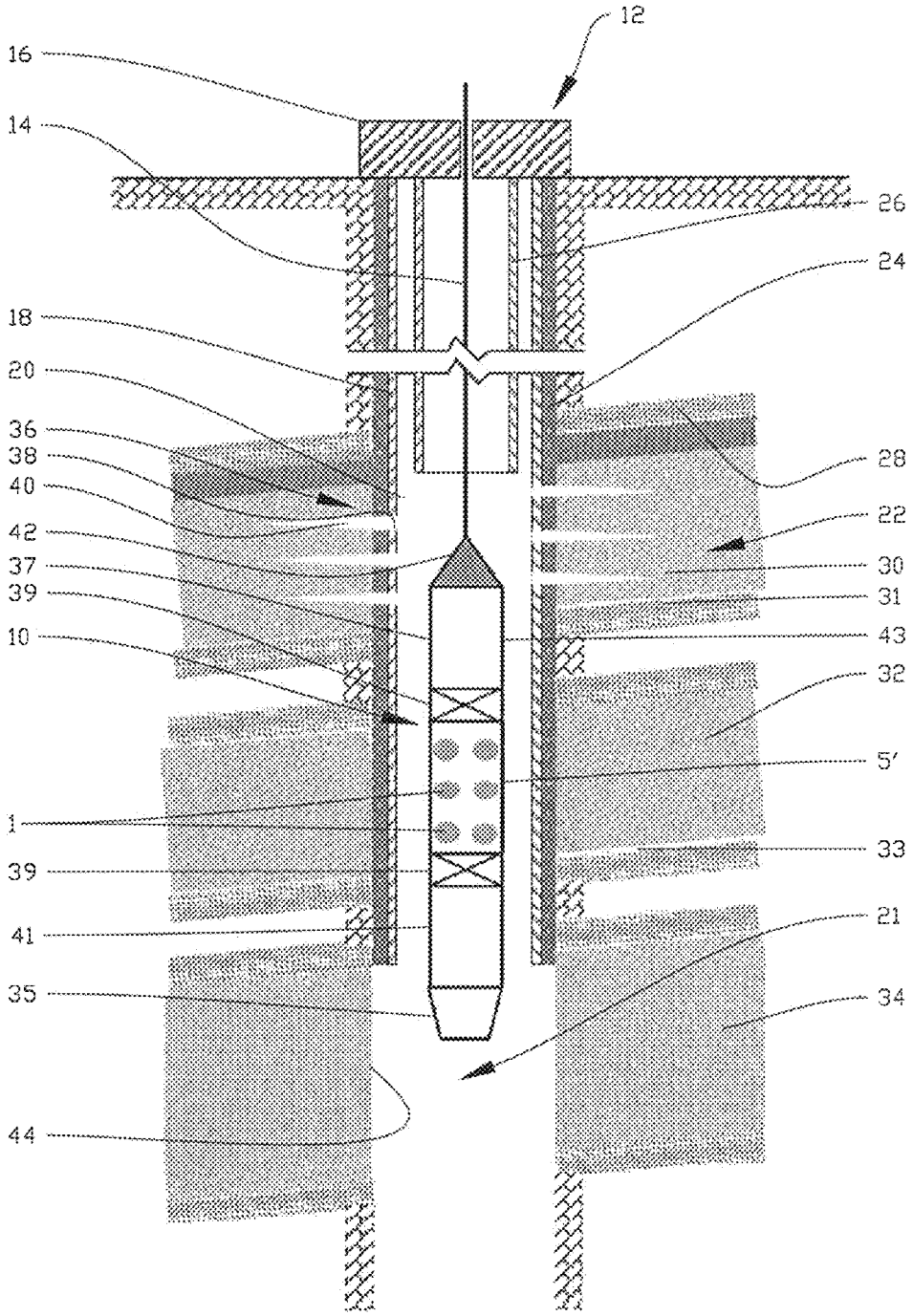
FIG. 9 shows a tool assembly according to the second aspect of present invention.

FIG. 9 illustrates a tool assembly 10 according to the second aspect of the present invention comprising a plurality of acoustic shock wave devices 1 according to the first aspect of the invention. The tool assembly being deployed into a well 12 on a wellbore conveying means in the form a wireline 14. The well 12 is completed by means of a wellhead 16 at the surface. Below the wellhead 16 an outer casing 18 extends into the well 12, the outer casing 18 constituting a radial delimitation between a portion of a wellbore 20 of the well 12 and a downhole formation 22. A layer of cement 24 is provided in the annulus between the outer casing 18 and the formation 22 in order to keep the outer casing firmly in place and to prevent unwanted leaks from the formation 22 and into the annulus between the outer casing 18 and the formation 22. An open bottom tubing 26, shorter than the outer casing 18 and with a smaller diameter than the outer casing 18, is shown extending from the wellhead 16 and down into the wellbore 20 substantially concentrically inside the outer casing 18.

Below the outer casing 18, the wellbore 20 extends further into the formation as an open-hole configuration section 21. In the shown embodiment, the upper portion of the formation 22 includes an area of cap rock 28, while a lower portion of the formation includes permeable zones 30, 32, 34. In the shown embodiment perforations 36 have already be formed in the formation 22 in the upper permeable zone 30. The perforations 36 include perforation openings 38 formed in the outer casing 18 and continuous perforation tunnels 40 extending from the perforation openings 38, through the cement 24 and in to the upper permeable zone 30. A mid permeable zone 32 exists below the upper permeable zone 30, outside a lower portion of the outer casing 18, whereas a lower permeable zone exists adjacent the wellbore in the open-hole section 21. A mid non-permeable zone 31 separates the upper permeable zone 30 and mid permeable zone 32, while a lower non-permeable zone 33 separates the mid permeable zone 32 and the lower permeable zone 34. The perforations 36 have been formed using not shown shaped explosive charges. The tool assembly 10 is connected to the wireline 14 at a cable head 42 of the tool assembly 10. The wireline 14 is adapted to transmit low/high power electricity and/or laser energy from a not shown power generator and/or laser generator at the surface to a laser cutting tool 35. In the shown embodiment, the tool assembly further comprises a formation imaging members 37, particularly useful for monitoring the excavation and quality of the perforations 36. The formation imaging member 37 may be of any type mentioned herein. Further, the tool assembly comprises pair of inflatable packers 39 adapted to create isolate a portion of the wellbore 20 if needed. The inflatable packers may e.g. be used for creating local underbalanced conditions in the wellbore 20 in the part of the formation 22 being perforated. The tool assembly 10 further comprises a perforation opening localization member 41, which may be of any type mentioned herein. The tool assembly 10 in the shown embodiment is adapted to convert, store/accumulate and discharge power received from the surface by means of an acoustic shock wave sub 43, the acoustic shock wave sub 43 typically including a transformer, capacitors or other accumulators, and a discharge unit in order to power the plurality of acoustic shock wave devices 1 according to the first aspect of the invention when needed. The activation may be automatically triggered or by means of command from the surface. It should be noted that the different features of the tool assembly 10 may be provided in different arrangements and orders, and that the tool assembly 10 according to the second aspect of the invention, in the widest sense, is defined by the claims.

Hereinafter different possible methods of operations, as also mentioned previously herein, will be briefly explained. In a first mode of operation, the tool assembly 10 may be lowered down to the lower permeable zone 34 in the open-hole section 21 of the wellbore 20. After positioning the tool assembly adjacent the lower permeable zone 34, the plurality of acoustic shock wave devices 1 according to the first aspect of the invention may be activated so as to focus a plurality of acoustic shock waves onto the borehole 44 of the un-cased wellbore 20. The part of the tool assembly 10 comprising the plurality of acoustic shock wave devices 1 according to the first aspect of the invention is covered by a flexible membrane 5'. The focused acoustic shock waves may be of the concentrated or directed types described above. The overall idea is that the focused projection F, as shown in FIGS. 4-8, of the acoustic shock waves onto the borehole 44 has a sufficiently high acoustic power density to disintegrate the formation 22 within the focused area. By repeating the generation process a substantial number of times, perforation holes will form in the borehole 44 extending into not shown perforation tunnels in the lower permeable zone 34 by gradual excavation thereof. If a series of concentrated acoustic shock waves is used, the focus area will typically remain at the perforation opening, where the borehole 44 has been perforated, also when excavating the perforation tunnel, then by way of a "water-hammer effect" as mentioned previously herein. If a directed acoustic shock wave is used, the focus will remain directed into the axial direction of the gradually excavated perforation tunnel. As mentioned above, the perforation tunnel may be formed with a vertical component along the axial direction thereof, typically by slightly lowering the tool assembly after first having excavated shallow holes in the borehole 44, following the steps as mentioned above. Then directing slightly upwardly, automatically or controlled from the surface, the acoustic shock wave devices 1 with their acoustic shock wave focusing members, by way of not shown mechanical means individually coupled to each device, aligning the devices' focus areas within the shallow holes just generated, re-activating the plurality of acoustic shock wave devices 1 to gradually excavate not shown perforation tunnels into the lower permeable zone 34, now with a vertical component along the axial direction thereof, thus simplifying the removal of debris from the perforation tunnel and into the wellbore 20. By generating acoustic shock waves resulting in power densities just above the required formation degeneration densities perforations may be made that do not comprise the virgin permeability of the lower permeable zone 34, nor other parts of the wellbore 20, and therefore increases the overall productivity/injectivity of the well 12. In one embodiment, the steps in the mentioned first mode of operation may be used in combination with, or as a pre-step to, running a not shown downhole wireline formation tester, such as a MDT (modular formation dynamics tester) tool or similar, for the purpose of enhancing the coupling between the probe(s) of the wireline formation tester and the borehole 44, as well as the communication between the borehole 44 and a more virgin (not shown, lesser drilling mud contaminated) formation, for improved measurement/sampling quality.

In a second mode of operation, the tool assembly 10 may be lowered down to the mid-permeable zone 32. The mid-permeable zone 32 is delimitated from wellbore 22 by means of the outer casing 18 and cement 24 as described above. The acoustic shock wave devices 1 are, in the shown embodiment, not adapted to make perforation openings through the casing 18. Instead the tool assembly is provided with high power laser cutting tool 35 for making not shown perforation openings in the outer casing 18. References to relevant prior art documents disclosing examples of such laser cutting tools 35 were given above. Perforation openings in the outer casing 18 may also be formed using other casing perforation members as previously discussed, or the perforation openings may be pre-formed in the outer casing 18 and activatable by means of not shown sliding or rotation casing sleeves. After perforation openings have been formed, the plurality of acoustic shock wave devices 1 as included in the tool assembly 10 are directed with their acoustic shock wave focusing members toward the perforation openings formed in the outer casing 18, so as to gradually excavate not shown continuous perforation tunnels through the cement 24 and into the permeable zone 32.

In a third mode of operation, the tool assembly 10 may be lowered to the upper permeable zone 30. In this embodiment, a plurality of perforations 36 have already been formed using not shown shaped explosive charges. The perforations 36 may have been formed during the same run, or during an earlier run into well 12. The tool assembly 10 is adapted to locate the perforation openings 38 in the outer casing 18, by means of the perforation opening localization member 41, and to align the plurality acoustic shock wave devices 1 with the openings perforation openings 38. The acoustic shock wave devices will subsequently be activated to generate a series of consecutive focused acoustic shock waves in order to gradually, and gently improve the perforation tunnels 40, improving typically implying widening and/or extending.

The different modes of operation discussed above may be used in one and the same well or in different wells. The different zones shown in FIG. 9 and discussed above may therefore also be construed as representing different wells.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A device for perforation of a downhole formation, the device comprising:

a single electronically induced acoustic shock wave generator; and an acoustic shock wave focusing member that focuses acoustic shock waves from the single electronically induced acoustic shock wave generator non-divergingly in a propagation direction;

wherein the device is adapted to generate a series of acoustic shock waves and to focus the series of acoustic shock waves onto a focus area of a borehole in order to disintegrate the downhole formation within the focus area to gradually excavate a perforation tunnel extending from the borehole and into the downhole formation in the propagation direction of the acoustic shock waves.

2. The device according to claim 1, wherein the acoustic shock wave focusing member is adapted to focus the series of acoustic shock waves in a non-spherical, collimated spatial forward projection onto the focus area.

3. The device according to claim 1, wherein the acoustic shock wave focusing member is adapted to concentrate the series of acoustic shock waves onto the focus area.

4. The device according to claim 1, wherein the device is at least partially covered by a flexible membrane.

5. The device according to claim 1, wherein the electronically induced acoustic shock wave generator is an electro-hydraulic acoustic shock wave generator.

6. The device according to claim 1, wherein the series of acoustic shock waves are focused perpendicular to a wall of the borehole.

7. A tool assembly for perforation of a downhole formation, the tool assembly comprising:

a first device having a single electronically induced acoustic shock wave generator and an acoustic shock wave focusing member that focuses acoustic shock waves from the single electronically induced acoustic shock wave generator non-divergingly in a propagation direction, wherein the first device is adapted to generate a series of acoustic shock waves and to focus the series of acoustic shock waves onto a focus area of a borehole in order to disintegrate the downhole formation within the focus area to gradually excavate a perforation tunnel extending from the borehole and into the downhole formation in the propagation direction of the acoustic shock waves;

wherein the tool assembly is connectable to a wellbore conveying means.

8. The tool assembly according to claim 7, wherein the tool assembly further comprises a casing perforation member.

9. The tool assembly according to claim 7, wherein the tool assembly further comprises a perforation opening localization member.

10. The tool assembly according to claim 7, wherein the tool assembly is adapted to create local underbalanced pressure conditions in the wellbore adjacent the downhole formation being perforated.

11. The tool assembly according to claim 7, wherein the tool assembly further comprises a formation imaging member.

12. The tool assembly according to claim 7, wherein the tool assembly is at least partially covered by a flexible membrane.

13. The tool assembly according to claim 7, wherein the series of acoustic shock waves are focused perpendicular to a wall of the borehole.

14. The tool assembly according to claim 7, further comprising one or more additional devices each having a single electronically induced acoustic shock wave generator and an acoustic shock wave focusing member that focuses acoustic shock waves from the single electronically induced acoustic shock wave generator non-divergingly in a propagation direction, wherein the one or more additional devices are each adapted to generate a series of acoustic shock waves and to also focus the series of acoustic shock waves onto one or more additional focus areas of the borehole in order to disintegrate the downhole formation within the one or more focus areas to gradually excavate one or more perforation tunnels extending from the borehole and into the downhole formation in the propagation direction of the acoustic shock waves, wherein the one or more additional devices are operable concurrently with the first device such that additional perforation tunnels extending from the borehole and into the downhole formation are concurrently excavated in addition to the perforation tunnel excavated via the first device.

15. A method for operating a tool assembly for perforation of a downhole formation, the tool assembly comprising:

a device having a single electronically induced acoustic shock wave generator and an acoustic shock wave focusing member that focuses acoustic shock waves from the single electronically induced acoustic shock wave generator non-diveringly in a propagation direction, wherein the device is adapted to generate a series of acoustic shock waves and to focus the series of acoustic shock waves onto a focus area of a borehole in order to disintegrate the downhole formation within the focus area to gradually excavate a perforation tunnel extending from the borehole and into the downhole formation;

wherein the tool assembly is connectable to a wellbore conveying means;

the method comprising:

(A) running the tool assembly into a well on a tool assembly conveying means and positioning the tool assembly adjacent a downhole formation in the well;

(B) activating the acoustic shock wave generator;

(C) focusing the series of acoustic shock waves generated by the device onto the focus area of the borehole in order to disintegrate the downhole formation within the focus area; and (D) gradually excavating the perforation tunnel via the series of acoustic shock waves in the propagation direction in which the device generates the series of acoustic shock waves.

16. The method according to claim 15, wherein the method, prior to steps (B) (D) further comprises:

(Al) creating perforation openings in at least one of a downhole casing or liner via a casing perforation member.

17. The method according to claim 16, wherein the method, prior to steps (B) (D) further comprises:

(A2) localizing one or more already existing perforation openings in a casing via a perforation opening localization member.

18. The method according to claim 15, wherein step (D) further comprises:

(D1) excavating the perforation tunnel with an axial direction having a vertical component.

19. The method according to claim 15, wherein the method further comprises:

(E) maintaining the wellbore at a pressure lower than the formation pressure, at least in the area around the tool assembly when in operation.

20. The method according to claim 15, wherein the series of acoustic shock waves are focused perpendicular to a wall of the borehole.

* * * * *